US006792863B2

(12) United States Patent
Yamamoto et al.

(10) Patent No.: US 6,792,863 B2
(45) Date of Patent: Sep. 21, 2004

(54) PRINTING APPARATUS FOR AUTOMATICALLY CONTROLLING INK SUPPLY DEVICE

(75) Inventors: Takaharu Yamamoto, Kyoto (JP); Nobuhito Kohara, Kyoto (JP); Shigeo Murakami, Kyoto (JP)

(73) Assignee: Dainippon Screen Mfg Co., Ltd., Kyoto (JP)

( * ) Notice: Subject to any disclaimer, the term of this patent is extended or adjusted under 35 U.S.C. 154(b) by 0 days.

(21) Appl. No.: 10/266,703

(22) Filed: Oct. 9, 2002

(65) Prior Publication Data

US 2003/0070570 A1 Apr. 17, 2003

(30) Foreign Application Priority Data

Oct. 15, 2001 (JP) ..... 2001/316333

(51) Int. Cl.[7] ..... B41F 31/14; B41F 31/02

(52) U.S. Cl. ..... 101/484; 101/365; 101/232; 101/233

(58) Field of Search ..... 101/365, 335, 101/484, 237, 233, 350.4; 400/120.09, 582

(56) References Cited

U.S. PATENT DOCUMENTS

| | | | | | |
|---|---|---|---|---|---|
| 3,567,923 | A | * | 3/1971 | Hutchison | 101/484 |
| 3,835,777 | A | * | 9/1974 | Krygeris | 101/350.4 |
| 4,901,254 | A | * | 2/1990 | Dolezalek et al. | 356/405 |
| 5,126,754 | A | * | 6/1992 | Spinar et al. | 346/29 |
| 5,148,747 | A | * | 9/1992 | Rodi et al. | 101/450.1 |
| 5,182,721 | A | | 1/1993 | Kipphan et al. | 382/112 |
| RE35,495 | E | | 4/1997 | Bolza-Schuenemann et al. | 101/232 |
| 5,724,437 | A | * | 3/1998 | Bucher et al. | 382/112 |
| 5,816,164 | A | | 10/1998 | Löffler | 101/484 |
| 5,841,955 | A | * | 11/1998 | Wang | 358/1.9 |
| 5,907,999 | A | * | 6/1999 | Lusar et al. | 101/484 |
| 5,967,049 | A | * | 10/1999 | Seymour et al. | 101/484 |
| 6,029,577 | A | | 2/2000 | Fukuoka et al. | 10/492 |
| 6,041,708 | A | | 3/2000 | Kipphan et al. | 101/365 |
| 6,119,594 | A | * | 9/2000 | Kipphan et al. | 101/365 |
| 6,318,259 | B1 | * | 11/2001 | Chou et al. | 101/350.5 |
| 6,318,260 | B1 | * | 11/2001 | Chu et al. | 101/365 |
| 6,446,555 | B1 | * | 9/2002 | Schramm et al. | 101/365 |
| 6,491,458 | B2 | * | 12/2002 | Hori et al. | 400/582 |
| 6,499,402 | B1 | * | 12/2002 | Sikes et al. | 101/484 |
| 6,536,341 | B2 | * | 3/2003 | Shiki et al. | 101/365 |
| 6,539,863 | B2 | * | 4/2003 | Shiraishi | 101/365 |

FOREIGN PATENT DOCUMENTS

| | | |
|---|---|---|
| DE | 0 863 002 B1 | 6/2001 |
| JP | 04-221641 | 8/1992 |
| JP | 2824334 | 9/1998 |
| JP | 10-244652 | 9/1998 |
| JP | 2001-253054 | 9/2001 |

* cited by examiner

*Primary Examiner*—Ren Yan
*Assistant Examiner*—Wasseem H. Hamdan
(74) *Attorney, Agent, or Firm*—McDermott, Will & Emery

(57) ABSTRACT

A printing apparatus has a manual control mode. The manual control mode has a proportion indication, a proportion adjustment key, a selected range adjustment key, and region selection keys. In the manual control mode, an operator selectively touches the region selection keys to select a region in which an ink key opening is to be changed. Next, the operator touches the selected range adjustment key to change the ink key opening of the selected region. The ink key opening is increased or decreased by the percentage indicated at the proportion indication the number of times the selected range adjustment key is touched. The settings made in the manual control mode are stored in a storage section, and are used to control the amount of ink supply during automatic control. Thus, the printing apparatus having the function of automatically controlling the printed density can make partial tone changes.

8 Claims, 7 Drawing Sheets

PRINTING APPARATUS FOR AUTOMATICALLY CONTROLLING INK SUPPLY DEVICE

BACKGROUND OF THE INVENTION

1. Field of the Invention

The present invention relates to a printing apparatus including an ink supply device such as an ink duct device, and more particularly to a technique for automatically adjusting the ink supply device.

2. Description of the Background Art

A typical offset printing apparatus includes a plurality of ink duct (or ink fountain) devices having ink keys, and can supply variable amounts of ink to respective segments extending across a predetermined feed direction of a paper sheet to be printed. This controls the amount of ink supply in accordance with the area of an image on a printing plate.

A conventional printing apparatus as described above has been adapted to measure the printed density and printed color on a printed paper sheet and to compare the measured printed density and the measured printed color with a preset target printed density and a preset target printed color, thereby effecting feedback control of the amount of ink supply.

The printing apparatus effecting the automatic control so that the measured printed density is approximately equal to the target printed density allows even an inexperienced operator to produce properly printed sheets.

There are, however, cases where a printed sheet is desired to be manually tint-corrected, for example, where it is desired that red is enhanced above normal in part of a finished printed sheet, based on the sensibilities of an operator or a designer. In such cases, the use of automatic setting makes it impossible to make partial adjustments.

SUMMARY OF THE INVENTION

The present invention is intended for a technique related to a printing apparatus including an ink supply device such as an ink duct device.

According to the present invention, a printing apparatus for applying ink to a printing medium while feeding the printing medium in a predetermined feed direction, thereby to provide a printed sheet, comprises: an ink supply mechanism for individually supplying a desired amount of ink through a plurality of ink transfer mechanisms to a plurality of regions defined on the printing medium to provide the printed sheet, each of the regions extending in the feed direction; a density setting element for setting a target printed density for all of the plurality of regions; an image reader provided in a feed path of the printed sheet for capturing an image on the printed sheet to obtain captured image data; an computation device for processing the captured image data to compute a measured printed density for each of the regions; a controller for controlling the amount of ink supplied from the ink supply mechanism for each of the regions so that the measured printed density is approximately equal to the target printed density; and a changing element for changing control by the controller in response to an instruction from an operator, whereby the controller controls the amount of ink supply to a selected one of the regions, based on the instruction from the operator.

This gives a higher priority to the conditions set by manual control and allows the conditions to be transferred to automatic control, thereby readily making partial tone changes and the like.

Preferably, the changing element includes a change key for changing the amount of ink supply for each of the regions in the designated proportion, whereby the controller changes the amount of ink supply to the selected region in the designated proportion each time the change key is manipulated.

Preferably, the changing element includes setting key for determining whether or not to cause the instruction to take effect for the controller.

It is therefore an object of the present invention to provide a printing apparatus capable of making a partial tone change while automatically controlling a printed density and, particularly, capable of reflecting manually set conditions in automatic settings.

These and other objects, features, aspects and advantages of the present invention will become more apparent from the following detailed description of the present invention when taken in conjunction with the accompanying drawings.

DESCRIPTION OF THE PREFERRED EMBODIMENTS

Description of Printing Apparatus

Figure 1A:
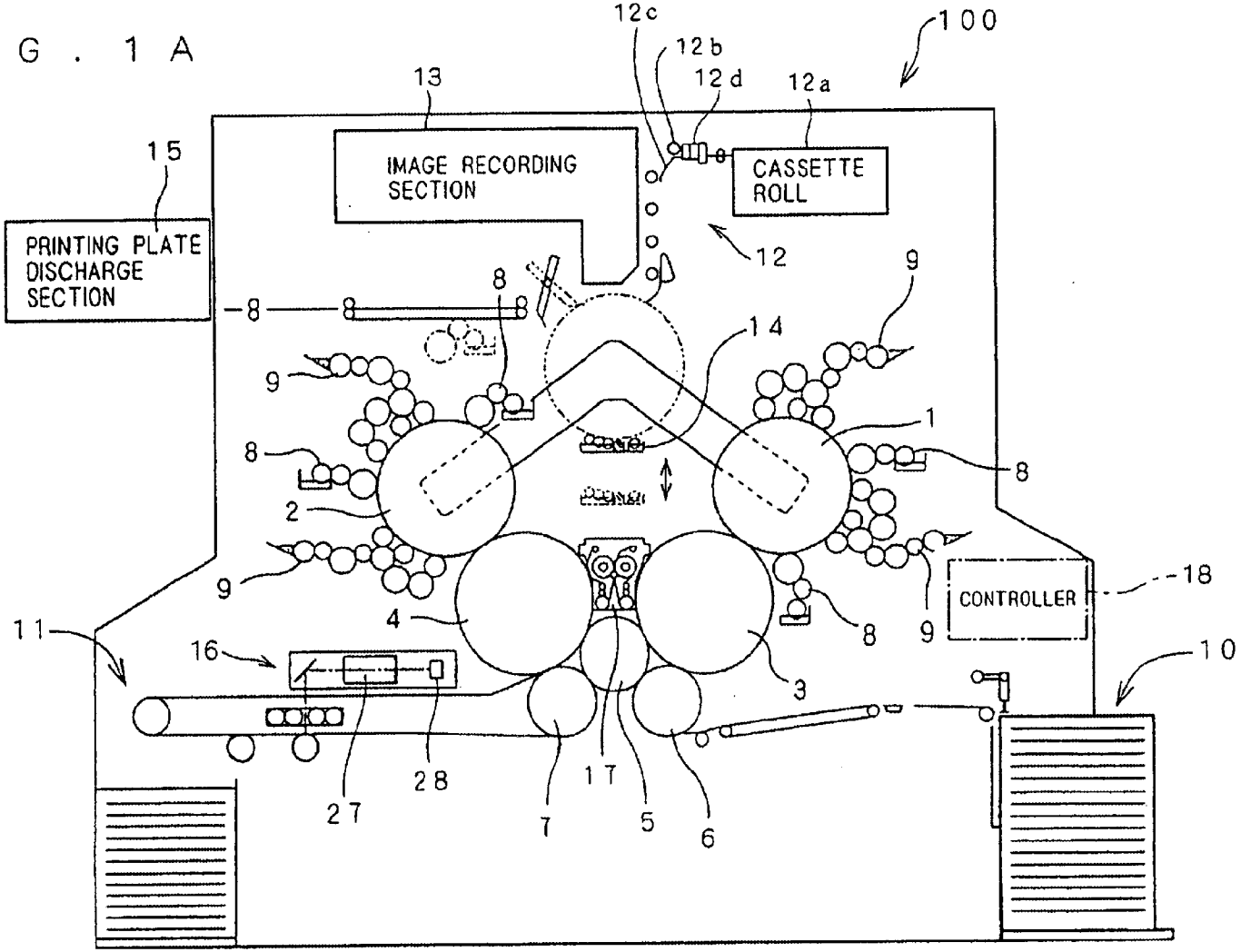
FIG. 1A is a schematic view of an example of a printing apparatus according to a preferred embodiment of the present invention.

A printing apparatus 100 according to a preferred embodiment of the present invention will now be described with reference to the drawings. FIG. 1A is a schematic view of an example of the printing apparatus 100. Referring first to FIG. 1A, the printing apparatus 100 comprises, as a printing mechanism: first and second plate cylinders (or ink transfer mechanisms) 1 and 2 for holding printing plates; first and second blanket cylinders 3 and 4 for transfer of an ink image from the respective plate cylinders 1 and 2 thereto; an impression cylinder 5 for holding a paper sheet (or a printing medium) p to be printed to which the ink image is transferred from the blanket cylinders 3 and 4; a paper feed cylinder 6 and a paper discharge cylinder 7 for feeding and discharging the sheet p to and from the impression cylinder 5; dampening water supply mechanisms 8 and ink supply mechanisms 9 for supplying dampening water and ink, respectively, to the printing plates on the first and second plate cylinders 1 and 2; a paper feed section 10 for sequentially feeding unprinted paper sheets p arranged in a stacked relation; and a paper discharge section 11 for sequentially receiving printed paper sheets p to form a stack.

As a prepress (or plate making) mechanism, the printing apparatus 100 comprises: a printing plate supply section 12 for supplying unexposed printing plates to the first and second plate cylinders 1 and 2; an image recording section 13 for recording an image on the printing plates held on the plate cylinders 1 and 2; a development section 14 for developing the printing plates with the image recorded thereon; and a printing plate discharge section 15 for discharging used printing plates.

The printing apparatus 100 further comprises an image reader 16 for capturing an image on the printed sheet p to measure an image density; a cleaning device 17 for cleaning the blanket cylinders 3 and 4; and a controller 18 for controlling the overall printing apparatus 100.

The parts of the printing apparatus 100 will be described in detail. The first plate cylinder 1 is movable by a plate cylinder drive mechanism not shown between a first printing position shown by a solid line in FIG. 1A and an image recording position shown by a dash-double dot line. Likewise, the second plate cylinder 2 is movable by a plate cylinder drive mechanism not shown between a second printing position shown by a solid line in FIG. 1A and the image recording position shown by the dash-double dot line. Specifically, the first and second plate cylinders 1 and 2 are in the first and second printing positions, respectively, when a printing process is performed, and are alternately located in the image recording position when a prepress (or plate making) process is performed on the printing plates held on the plate cylinders 1 and 2. Each of the first and second plate cylinders 1 and 2 has a peripheral surface capable of holding thereon two printing plates for two respective colors, and includes a pair of gripping mechanisms for fixing the printing plates, respectively, in circumferentially opposed positions 180 degrees apart from each other on the peripheral surface.

The first blanket cylinder 3 is adapted to rotate in contact with the first plate cylinder 1 in the first printing position. Likewise, the second blanket cylinder 4 is adapted to rotate in contact with the second plate cylinder 2 in the second printing position. The first and second blanket cylinders 3 and 4 are approximately equal in diameter to the first and second plate cylinders 1 and 2, and have a blanket mounted on their peripheral surface for transfer of ink images of two colors from the plate cylinders 1 and 2.

The impression cylinder 5 has a diameter approximately one-half the diameter of the first and second plate cylinders 1 and 2, and is adapted to rotate in contact with both of the first and second blanket cylinders 3 and 4. The impression cylinder 5 includes a gripping mechanism capable of holding the single sheet p having a size corresponding to that of the printing plate. The gripping mechanism is opened and closed in predetermined timed relation by an opening/closing mechanism not shown to grip a leading end of the sheet p.

The paper feed cylinder 6 and the paper discharge cylinder 7 are approximately equal in diameter to the impression cylinder 5, and each includes a gripping mechanism (not shown) similar to that of the impression cylinder 5. The gripping mechanism of the paper feed cylinder 6 is positioned to pass the sheet p in synchronism with the gripping mechanism of the impression cylinder 5, and the gripping mechanism of the paper discharge cylinder 7 is positioned to receive the sheet p in synchronism with the gripping mechanism of the impression cylinder 5.

The first and second plate cylinders 1 and 2 in the first and second printing positions, the first and second blanket cylinders 3 and 4, the impression cylinder 5, the paper feed cylinder 6 and the paper discharge cylinder 7 are driven by a printing driving motor not shown to rotate in synchronism with each other. In the printing apparatus 100, since the plate cylinders 1 and 2 and the blanket cylinders 3 and 4 have a circumference approximately twice greater than that of the impression cylinder 5, the impression cylinder 5 rotates two turns each time the plate cylinders 1 and 2 and the blanket cylinders 3 and 4 rotate one turn. Thus, two turns of the impression cylinder 5 with the sheet p held thereon effect multicolor printing using two colors from the first plate cylinder 1 and two colors from the second plate cylinder 2 or a total of four colors.

Two dampening water supply mechanisms 8 are provided for each of the plate cylinders 1 and 2 in the first and second printing positions, and are capable of selectively supplying the dampening water to the two printing plates on each of the plate cylinders 1 and 2. Each of the dampening water supply mechanisms 8 includes a water fountain for storing the dampening water, and a set of dampening water rollers for drawing up the dampening water from the water fountain to pass the dampening water to a printing plate surface. At least some of the set of dampening water rollers which contact the printing plate surface are brought into and out of contact with a plate cylinder surface by a cam mechanism. The dampening water supply mechanisms 8 need not be provided if the printing plates are of the type which requires no dampening water.

Figure 1B:
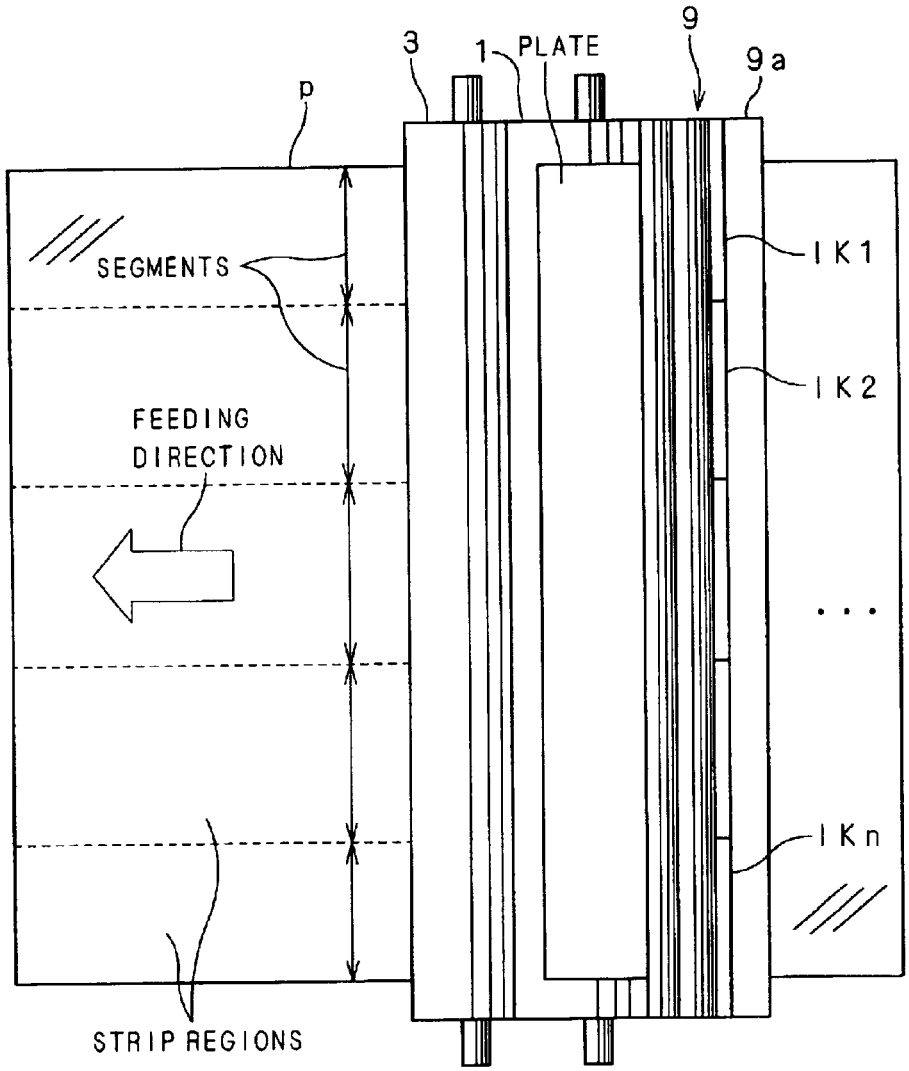
FIG. 1B is a schematic plan view illustrating transfer of ink from an ink supply mechanism to a print sheet.

Two ink supply mechanisms 9 are provided for each of the plate cylinders 1 and 2 in the first and second printing positions, and are capable of selectively supplying inks of different colors to the two printing plates on each of the plate cylinders 1 and 2. As illustrated in FIG. 1B, each of the ink supply mechanisms 9 includes an ink duct or ink fountain 9*a* capable of adjusting the amount of ink supply for each strip region extending in a predetermined feed direction (or forward direction) of the paper sheet p, and supplies the ink from the ink ducts through a plurality of ink rollers onto the printing plate surface on each of the plate cylinders 1 and 2. At least some of the ink rollers which contact the printing plate surface are brought into and out of contact with the plate cylinder surface by a cam mechanism. The ink duct 9*a* is provided with a plurality of ink keys IK1, IK2, . . . IKn. Respective amounts of ink supplied to a linear array of segments defined across the feed direction on the print paper p are independently adjusted by respective ink keys IK1, IK2, . . . IKn, whereby the ink density on respective strip regions on the print paper p are controlled. Only the part including the plate cylinder 1 and the blanket cylinder 2 is illustrated in FIG. 1B, and that including the plate cylinder 3 and the blanket cylinder 4 in FIG. 1A has a similar configuration.

The inks in the ink supply mechanisms 9 are, for example, such that the ink supply mechanisms 9 for K (black) and M (magenta) colors are provided for the first plate cylinder 1, and the ink supply mechanisms 9 for C (cyan) and Y (yellow) colors are provided for the second plate cylinder 2. At least some of the dampening water supply mechanisms 8 and ink supply mechanisms 9 which lie on the paths of movement of the first and second plate cylinders 1 and 2 are adapted to be shunted out of the paths of movement as the first and second plate cylinders 1 and 2 move.

The paper feed section 10 feeds paper sheets p, one at a time, from a stack of unprinted paper sheets p to the paper feed cylinder 6. In this preferred embodiment, the paper feed section 10 operates so that one paper sheet p is fed each time the paper feed cylinder 6 rotates two turns. The paper discharge section 11 receives printed paper sheets p from the paper discharge cylinder 7 to form a stack. The paper discharge section 11 includes a known chain transport mechanism for discharging and carrying a printed paper sheet p, with the leading end of the printed paper sheet p gripped by a gripper (or gripper finger) carried around by a chain. The image reader 16 is provided at some midpoint in the path of movement of the printed sheets p discharged by the paper discharge section 11.

Next, the prepress mechanism of the printing apparatus 100 will be described. In the printing apparatus 100, the first and second plate cylinders 1 and 2 are alternately moved to the image recording position during the execution of the prepress process. In this image recording position, a friction roller not shown is driven to rotate in contact with the plate cylinder 1 or 2.

The printing plate supply section 12 includes a cassette roll 12*a* for storing a roll of unexposed printing plate while shielding the roll of unexposed printing plate from light, a transport roller 12*b* and a transport guide 12*c* for transporting the printing plate unwound from the cassette roll to the plate cylinder 1 or 2, and a cutting mechanism 12*d* for cutting the printing plate into sheet form. In this preferred embodiment, a silver halide sensitive material is used for the printing plate, and laser light is used to record an image on the printing plate. The procedure of a printing plate supply operation includes: causing one of the gripping mechanisms not shown of the plate cylinder 1 or 2 to grip the leading end of the printing plate unwound from the cassette roll; rotating the plate cylinder 1 or 2 in this condition to wind the printing plate around the plate cylinder 1 or 2; then cutting the printing plate to length; and causing the other gripping mechanism to grip the trailing end of the printing plate.

The image recording section 13 turns on/off laser light to expose a printing plate to the light, thereby recording an image on the printing plate. In this preferred embodiment, the controller 18 determines the position of the image on the printing plate, and sends corresponding image data to the image recording section 13. The image recording section 13 effects main scanning with the laser light emitted from a laser source in the axial direction of the plate cylinder 1 or 2 by using a polarizer such as a polygon mirror, while effecting sub-scanning over the printing plate surface by rotating the plate cylinder 1 or 2. The method of scanning may be of the type such that a plurality of laser sources are arranged in the axial direction of a plate cylinder and main scanning is carried out with a plurality of laser beams emitted from the respective laser sources as the plate cylinder rotates. The printing plate and the image recording section 13 are not limited to those of the type such that an image is recorded by exposure to light, but may be of the type such that an image is thermally or otherwise recorded.

The development section 14 develops the printing plate exposed by the image recording section 13. In this preferred embodiment, the development section 14 draws up a processing solution stored in a processing bath by using a coating roller to apply the processing solution to the printing plate, thereby developing the printing plate. The development section 14 includes an elevating mechanism for moving between a position in which the development section 14 is shunted from the plate cylinder 1 or 2 and a position in which the development section 14 is closer to the plate cylinder 1 or 2. The development section 14 itself need not be provided if an image recording method which requires no development is employed.

In the printing apparatus 100, the first and second plate cylinders 1 and 2 are moved to the image recording position, in which the prepress process is performed by supplying the printing plate and then recording and developing an image. After the prepress process is completed, the first and second plate cylinders 1 and 2 are moved to the first and second printing positions, respectively, for the printing process.

The printing apparatus 100 is capable of automatically discharging the printing plate after the printing process is completed. In this preferred embodiment, the printing plate discharge section 15 includes a peeling section for peeling the printing plate from the first or second plate cylinder 1 or 2 in the image recording position, a transport mechanism for transporting the peeled printing plate, and a discharge cassette for discharging the used printing plate so transported.

Figure 2:
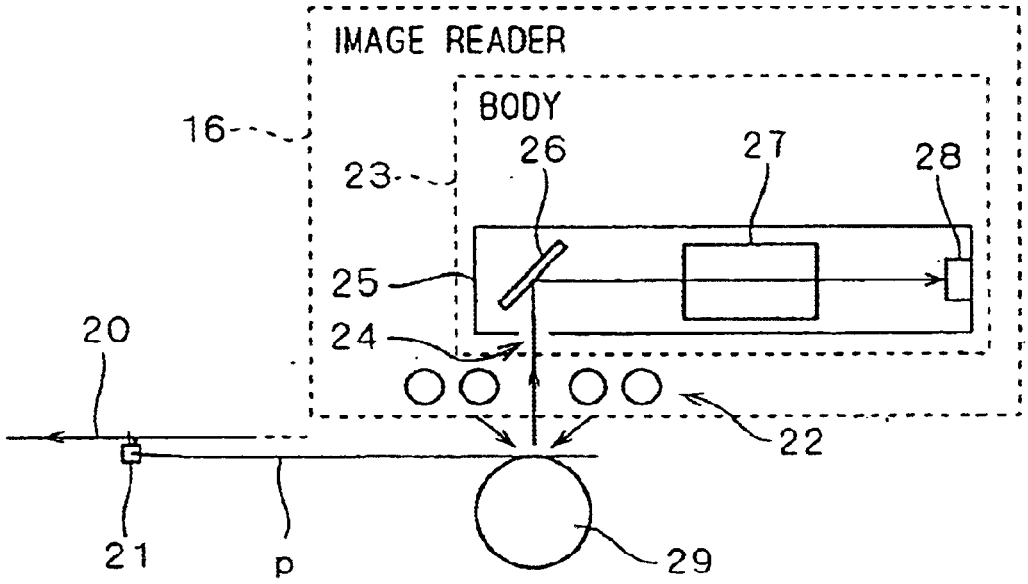
FIG. 2 is a schematic view of an image reader provided in the printing apparatus.

The details of the image reader 16 will be described with reference to the schematic view of FIG. 2. The image reader 16 reads an image on the printed paper sheet p gripped and transported by a gripper (or gripper finger) 21 carried around by a chain 20 of the paper discharge section 11. The image reader 16 includes an illuminating light source 22 for illuminating the printed paper sheet p, and a reader body 23 for receiving light reflected from the printed paper sheet p to convert the reflected light into an image signal.

The illuminating light source 22 includes a plurality of line light sources, e.g. fluorescent lamps, arranged in the feed direction of the printed paper sheet p. The reader body 23 includes a cover 25 formed with a permeable portion 24 for allowing the reflected light to pass therethrough, a reflecting mirror 26 provided in the cover 25, an optical system 27, and a photodetector 28.

The cover 25 blocks out disturbance light, dirt, ink mist and the like. The permeable portion 24 may be closed by using a light-permeable member or the like, or may be open. If the permeable portion 24 is open, it is preferable that a clean air from outside the printing apparatus 100 is introduced into the interior of the cover 25 to prevent dirt from entering the interior of the cover 25 through the permeable portion 24. The reflecting mirror 26 directs incident light from the printed paper sheet p toward the photodetector 28. The optical system 27 includes an optical member such as a lens for image-forming the incident light on the photodetector 28. The photodetector 28 includes a CCD line sensor for reading the printed image, line by line extending in a direction crosswise to the feed direction of the sheet p. This preferred embodiment employs a three-line CCD capable of reading three wavelengths for R, G and B.

The printed paper sheet p transported by the gripper 21 is vacuum-held and transported by a vacuum suction roller 29. This suppresses fluttering of the sheet p during image reading to stabilize the sheet p.

Figure 6:
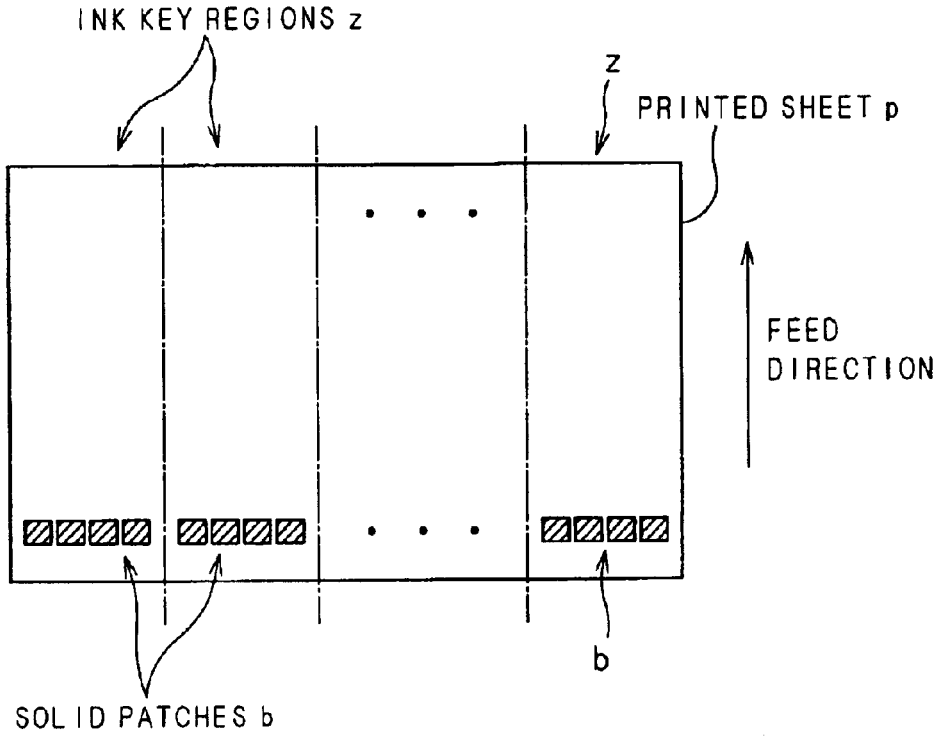
FIG. 6 illustrates an example of solid patches applied to a printed sheet.

It is desirable that the printed paper sheet p has a predetermined color chart previously formed thereon by the image recording section 13 for each of the regions (ink key regions z) corresponding to respective ink keys. As a typical example shown in FIG. 6, 100% dense solid patches b for respective CMYK colors are formed in an image end portion (typically, on the trailing end of the printed paper sheet p) in each of the ink key regions z. The image reader 16 is capable of imaging the solid patches b to measure the printed densities in the respective ink key regions z. The printed density as used herein refers to an optical reflectance density, for each of the RGB colors, which is measured by the use of a predetermined filter. For each of the YMCK colors, a target printed density to provide a standard printed color on a printed sheet is specified based on the reflectance density of the 100% dense solid patch of each ink. (The standard value thereof in Japan is specified as Japan color.) Other examples of the color charts includes other-than-100% dense halftone dot patches, line patches, and mixed color patches such as gray patches, which may be prepared and used to measure the printed densities and calorimetric densities. If the color charts and the like are not provided, the image reader 16, of course, may capture the printed image itself and measure the printed density and printed color of a predetermined region. The ink key regions z are arranged in a direction crosswise to (preferably, orthogonal to) the feed direction of the sheet p.

The cleaning device 17 comes in contact with the blanket cylinders 3 and 4 to clean the cylinder surfaces. In this preferred embodiment, individual cleaning devices are provided respectively for the blanket cylinders 3 and 4. The cleaning device 17 includes a cleaning solution supply mechanism, and a wiping mechanism using a cleaning cloth (or wiper).

The controller 18 is a microcomputer system including various input/output sections and storage sections, and is contained in the printing apparatus 100. The controller 18 controls the overall printing apparatus 100 based on a predetermined program operation, and also controls the image reader 16 and the ink supply mechanisms 9.

Specifically, the controller 18 controls the image reader 16 to intermittently read an image on a printed paper sheet (sample sheet) p once for every preset number of printed paper sheets, and also controls the ink supply mechanisms 9 (more specifically, the ink key opening of the ink duct) based on the measured printed density by a technique to be described layer.

In this preferred embodiment, the controller 18 controls the image reader 16 to periodically read an image once for every five sheets p. This frequency is substantially unattainable without direct provision of a measuring device (corresponding to the image reader 16 and the controller 18) in the printing apparatus 100. The control of the ink supply mechanisms 9 by the controller 18 is so-called feedback control which is specifically effected so that the printed density measured with predetermined frequency is made approximately equal to a preset target printed density.

The controller 18 also functions as a computation device for performing a computing process upon captured image data read by the image reader 16. For example, the controller 18 perform computation based on the captured image data obtained by the image reader 16, to determine desired measurement data. In this preferred embodiment, the controller 18 converts captured RGB image data obtained by the image reader 16 into image data (measurement data) representing YMCK densities, based on a known transformation. This provides the printed density for each YMCK color of the solid patch provided in each ink key region z.

Figure 3:
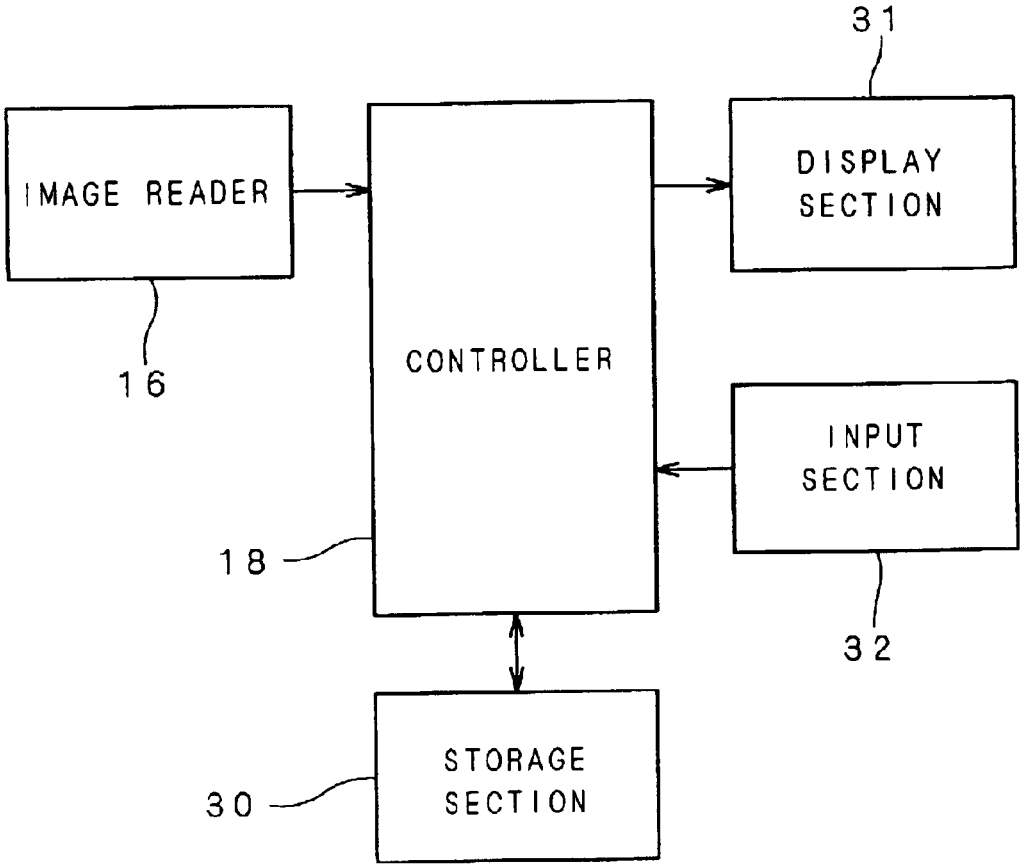
FIG. 3 is a block diagram of principal parts of the printing apparatus according to the present invention.

FIG. 3 is a block diagram according to the present invention. With reference to FIG. 3, the controller 18 is connected to the image reader 16, a storage section 30, a display section 31, and an input section 32. As described above, the controller 18 controls the image reader 16 to capture an image once for every preset number of printed paper sheets, and determines the measurement data including the printed density and the like from the captured image data. The measurement data thus obtained are stored in the storage section 30 including a hard disc, a memory and the like, and are read and used as required by the controller 18.

The display section 31 specifically corresponds to a CRT monitor, an LCD monitor or the like, and is capable of displaying the measurement data and the like. The input section 32 includes a keyboard, a mouse and the like. An operator can use the input section 32 to enter various conditions and to set instructions to the controller 18. In the printing apparatus 100 of the preferred embodiment, an LCD monitor having a touch panel input function is used as the display section 31 and the input section 32, and functional portions thereof are integrated together.

Figure 4:
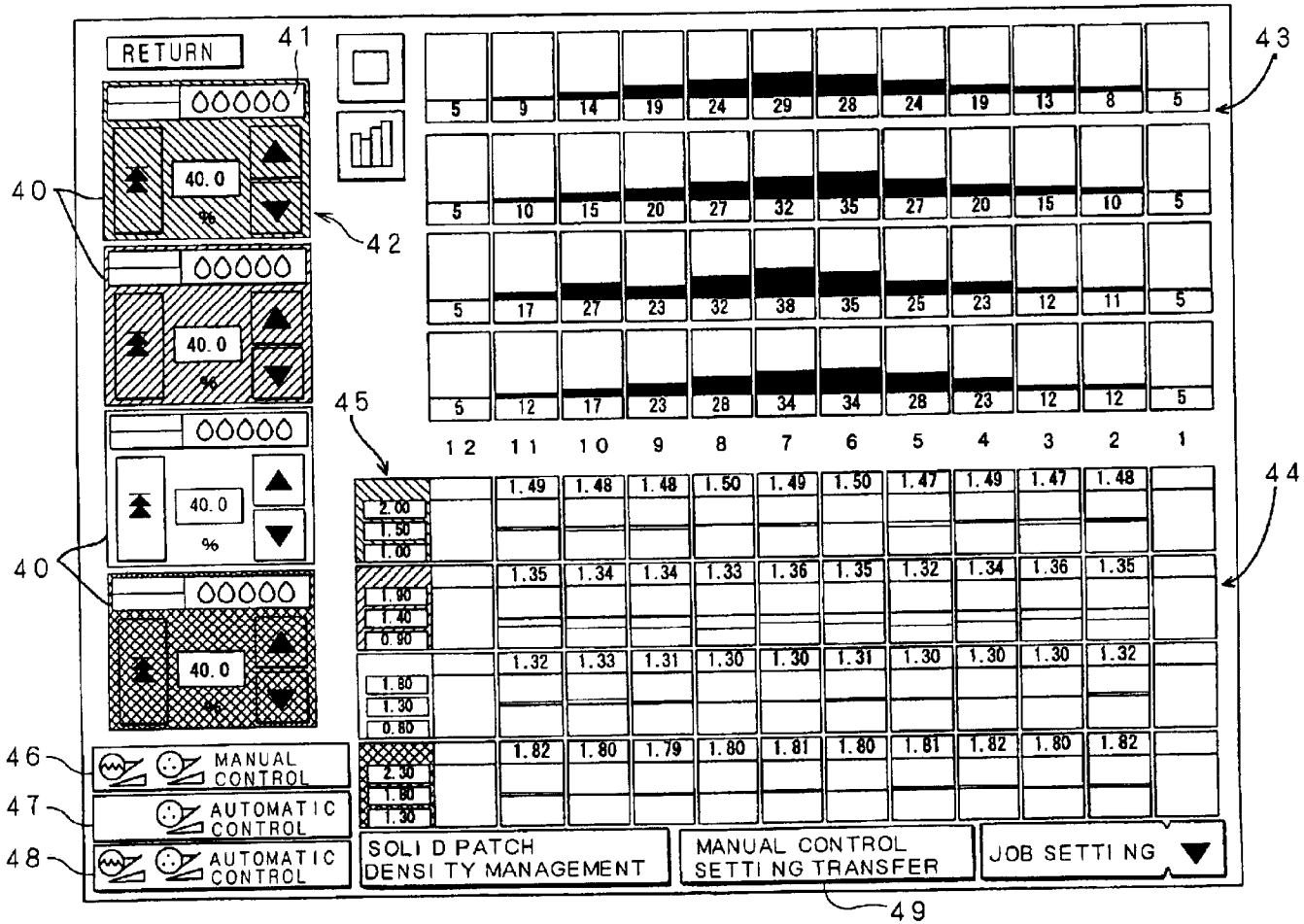
FIG. 4 is an example of a screen display for control of the amount of ink supply.
Figure 5:
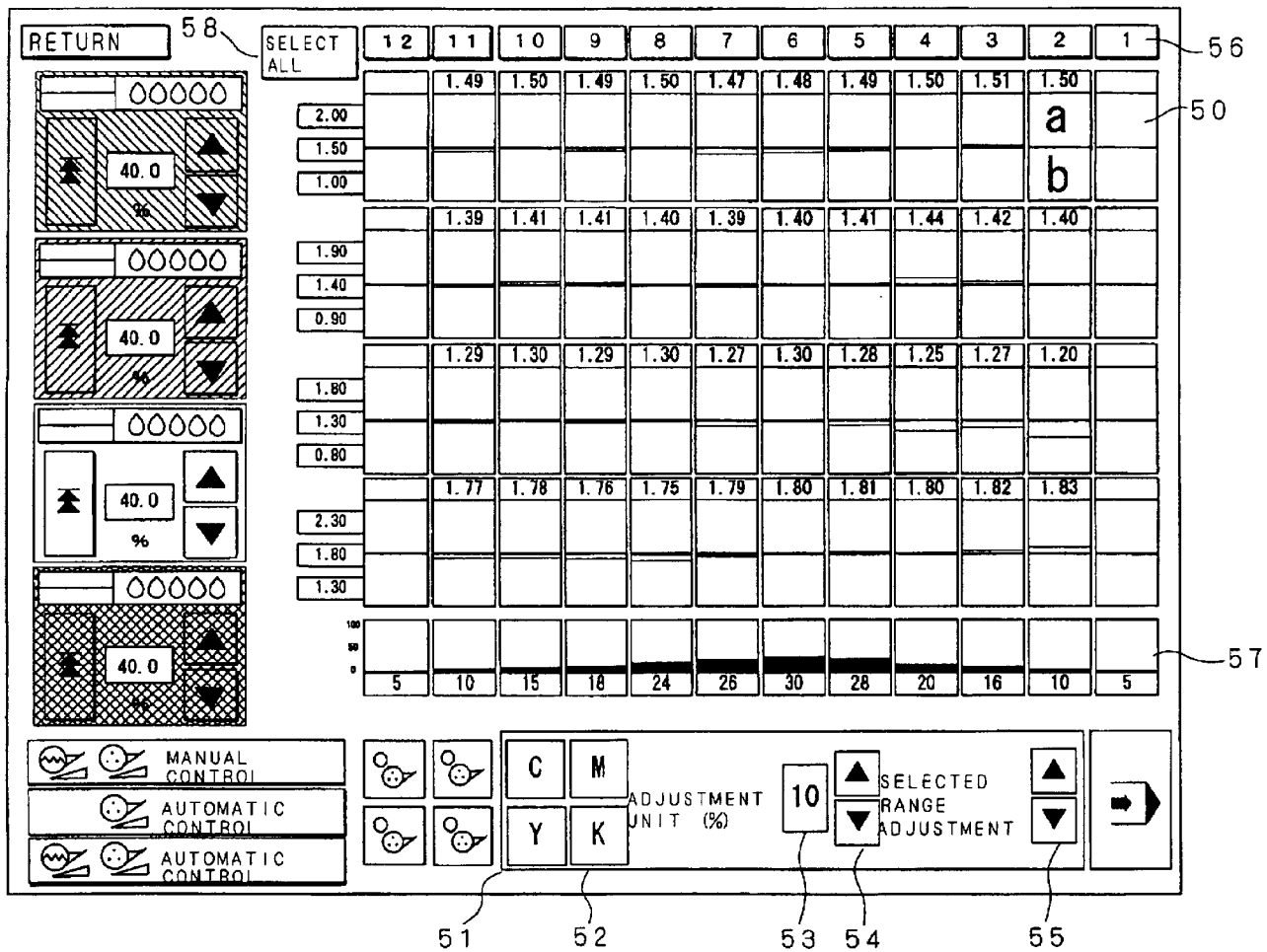
FIG. 5 is an example of a screen display for manual control of the amount of ink supply.

FIGS. 4 and 5 show examples of a screen displayed by the display section 31. A manual control procedure according to the preferred embodiment will be described with reference to the screen displays shown in. FIGS. 4 and 5. The manual control procedure refers to a procedure for manually changing the amount of ink supplied from the ink supply mechanisms 9 for each ink key region z.

FIG. 4 shows a display screen of the display section 31 showing the dampening water and ink being controlled during the printing operation. Referring to FIG. 4, water status indications 40 indicating the amount of dampening water being controlled by the dampening water supply mechanisms 8 appear on the left end of the screen. The water status indications 40 are provided respectively for CMYK colors. Each of the water status indications 40 contains a water monitor indication 41 providing a 5-step indication of the proper amount of dampening water, and a key 42 for manual up and down adjustment of the amount of dampening water supply. The details of the control of the amount of dampening water is not described herein.

In the upper half of the screen, ink key opening indications 43 for each of the ink key regions z which indicate the amount of ink supply appear for respective CMYK colors in the order named. The indications 43 have numerical and bar graph indications of the current amount of ink supply for each of the ink key regions z so that an operator can recognize the settings thereof. Although there are provided twelve ink key regions z (i.e., twelve ink keys) in this preferred embodiment, the number of ink key regions z is not limited thereto.

In the lower half of the screen, measured printed density indications 44 for each ink key region z appear for respective CMYK colors in the order named. Memory indications 45 appear to the left of the measured printed density indications 44. The memory indications 45 indicate the numerical range (the upper limit value, the median value and the lower limit value) of the bars presented by the measured printed density indications 44. The median value in the memory indications 45 is a preset target printed density. This target printed density is previously inputted and set from the input section 32, and is stored in the storage section 30. The amount of ink supply is controlled so that the measured printed densities are approximately equal to the stored target printed density. To make the measured printed density approximately equal to the target printed density, the controller 18 in this preferred embodiment computes the required amount of ink supply from the difference between the measured printed density and the target printed density to control the ink supply mechanisms 9 so that the amount of ink supply becomes equal to the computed amount. However, other control methods may be used, for example, which include controlling the ink key opening to increase in predetermined increments if the density is low. The target printed density is changeable during the printing operation, and the control based on the target printed density is effected substantially in real time as soon as the change is made.

In the example shown in FIG. 4, the target printed densities in a top to bottom sequence are as follows: 1.50 for C color, 1.40 for M color, 1.30 for Y color, and 1.80 for K color. Each of the printed density indications 44 appear in the form of a bar in a ±0.5 range around the target printed density. The bar presenting the measured current printed density indicates a higher density if it is above the centerline indicating the target printed density, and indicates a lower density if it is below the centerline. Depending on the difference from the target printed density, the color of the bar is changeable from green (indicating the small difference) to red (indicating the large difference) for increased visibility.

Three keys 46 through 48 for setting a printing control mode appear in a bottom left portion of the screen. The key 46 is a manual control key for manual setting of the dampening water and the ink. The key 47 is a key for automatic control of only the ink. The key 48 is a key for automatic control of both the dampening water and the ink. In general, the key 48 is used to effect the automatic control of both the ink and the dampening water. If the tone of part of an image is desired to be changed as described above, the key 46 is used to make the manual setting of the amount of ink supply. A setting transfer key 49 for transfer of settings made by the manual control appears in the middle of the bottom portion of the screen. Other keys are not described.

The manual control according to the present invention will be described. With a touch of the key 46 shown in FIG. 4, the screen of the display section 31 is changed to a manual control screen shown in FIG. 5. In the upper half of the screen shown in FIG. 5, measured printed density indications 50 for each ink key region z appear for respective CMYK colors in the order named. The measured printed density indications 50 are substantially similar to the indications 44 shown in FIG. 4, but have a display range (or a display area in the display section 31) expanded upwardly and downwardly so that an operator easily grasp the status. An indication 51 for manual adjustment of the amount of ink supply appears in the bottom portion of the screen. The indication 51 contains a color selection key 52 for selection of a color to be manually adjusted among the CMYK colors, a proportion indication 53 for indicating the proportion (%) in which the amount of ink supply is adjusted, a proportion adjustment key 54 for adjusting up and down the proportion, and a selected range adjustment key 55 for execution of the adjustment of the amount of ink supply in a selected ink key region z.

Region selection keys 56 for selection of the ink key regions z and including keys Nos. 1 through 12 appear over the indications 50. Ink key opening indications 57 indicating the current amount of ink supply for the color selected with a touch of the color selection key 52 appear between the indications 50 and the indication 51.

In the manual control screen shown in FIG. 5, an operator initially selects a color desired to be adjusted by touching the color selection key 52, and then sets the proportion for adjustment by touching the proportion adjustment key 54. For example, the adjustment proportion is set at 10%.

Next, the operator selectively touches the region selection keys 56 to select the ink key region z in which the amount of ink supply is desired to be changed. In this process, two or more ink key regions z may be simultaneously selected, or a select all key 58 may be touched if necessary to select all of the ink key regions z. The selected ink key region z is highlighted or otherwise suitably indicated.

Next, the operator touches the selected range adjustment key 55 to increase or decrease the amount of ink supply in the selected ink key region z. In the printing apparatus 100, each time the selected range adjustment key 55 is touched, the ink key opening is adjusted by the amount corresponding to the proportion. The adoption of the adjustment using the proportion is advantageous in substantially the same degree of increase or decrease in tone to be adjusted independently of whether the key opening is large or small. The ink key opening thus manually set is displayed at the indications 57, and is stored in the storage section 30 for each color and for each ink key region z.

In the above-mentioned example, the touch of the selected range adjustment key 55 changes the amount of ink supply for all of the selected ink key regions z at a time. Besides, the printing apparatus 100 is adapted to adjust the ink key opening for each of the ink key regions z in ±1 steps with a touch of the printed density indications 50 corresponding to each ink key region z. For example, a touch of the upper half of the bar indicating the target printed density in one of the indications 50, as designated by the reference character a, increases the second ink key opening by one, and a touch of the lower half of the bar, as designated by the reference character b, decreases the second ink key opening by one.

After completion of all manual settings, the operator touches a return button in a top left portion of the screen to change the screen of the display section 31 to the screen shown in FIG. 4. When the operator gets a touch to the automatic control key 47 or 48 while touching the manual control setting transfer key 49 in the screen shown in FIG. 4, the measured printed density at the ink key opening manually set on the manual control screen shown in FIG. 5 becomes a new target printed density in the corresponding ink key region z, and the automatic control operation is performed based on the new target printed density.

Specifically, the printing apparatus 100 normally performs the printing operation while automatically adjusting the ink key opening so that the measured printed density for each ink key region z is approximately equal to the previously set target printed density. If the manual control setting transfer is performed as described above, the measured printed density actually changed on the printed sheets depending on the manually set ink key opening is determined and defined as a new target printed density for the manually set ink key region z. For the manually set ink key region z, the controller 18 effects automatic control using the new target printed density as a target. This allows the manual setting of a partial change in tone and the like to be reflected in the automatic control of the amount of ink supply.

It should be noted that the change in printed density depending on the change in ink key opening is reflected precisely after several to tens of sheets are printed. It is therefore preferable that the operator carries out the setting transfer from manual control to automatic control in expectation of this time lag in the density change. Alternatively, the controller 18 may determine the measured printed density of a printed sheet which is a predetermined number of printed sheets later than the instant of manually changing the ink key opening, and define this measured printed density as a new target printed density for the changed ink key opening.

The printing apparatus 100 judges whether to cause the manual settings to take effect or not, depending on whether the setting transfer key 49 is touched or not, as discussed above. Thus, the printing apparatus 100 effects the normal automatic control without a touch of the setting transfer key 49. The use of the setting transfer key 49 is advantageous in easily meeting the requirements, if any, to return to the original automatic setting.

Although the ink key opening for each ink key region z is adjusted by manual control in the preferred embodiment, the target printed density may be made changeable individually for each ink key region z.

While the invention has been described in detail, the foregoing description is in all aspects illustrative and not restrictive. It is understood that numerous other modifications and variations can be devised without departing from the scope of the invention.

What is claimed is:

1. A printing apparatus for applying ink to a printing medium while feeding said printing medium in a predetermined feed direction, thereby to provide a printed sheet, said printing apparatus comprising:

an ink supply mechanism for individually supplying a desired amount of ink through a plurality of ink transfer mechanisms to a plurality of regions defined on said printing medium to provide said printed sheet, each of said regions extending in said feed direction;

a density setting element for setting a target printed density for all of said plurality of regions;

an image reader provided in a feed path of said printed sheet for capturing an image on said printed sheet to obtain captured image data;

an computation device for processing said captured image data to compute a measured printed density for each of said regions;

a controller for controlling the amount of ink supplied from said ink supply mechanism for each of said regions so that said measured printed density is approximately equal to said target printed density; and a changing element for changing said target printed density of one of said regions selected by an operator in response to an instruction from the operator, whereby said controller corrects and controls the amount of ink supply to said one of said regions selected by the operator, based on a target printed density instructed by said instruction from the operator.

2. The printing apparatus according to claim 1, wherein said instruction includes a first instruction for changing said amount of ink supply to said selected region in a designated proportion, and wherein said changing element defines a measured printed density of said selected region that is measured after said amount of ink supply has been changed as a new target printed density of said selected region, thereby to change said target printed density of said region selected by the operator.

3. The printing apparatus according to claim 2, wherein said changing element includes a change key for changing said amount of ink supply for each of said regions in said designated proportion, whereby said controller changes said amount of ink supply to said selected region in said designated proportion each time said change key is manipulated.

4. The printing apparatus according to claim 1, wherein said changing element includes a setting key for determining whether or not to cause said instruction to take effect for said controller.

5. The printing apparatus according to claim 1, wherein said instruction includes a second instruction for changing said target printed density during printing, and wherein said changing element defines a target printed density instructed by said second instruction as a new target printed density of said selected region, thereby to change said target printed density of said region selected by the operator.

6. The printing apparatus according to claim 1, wherein said changing element changes said target printed density for each of said regions to thereby change the amount of ink supplied from said ink supply mechanism for each of said regions.

7. A printing apparatus for applying ink to a printing medium while feeding said printing medium in a predetermined feed direction, thereby to provide a printed sheet, said printing apparatus comprising;

an ink supply mechanism for individually supplying a desired amount of ink through a plurality of ink transfer mechanisms to a plurality of regions defined on said printing medium to provide said printed sheet, each of said regions extending in said feed direction;

a density setting element for setting a target printed density for all of said plurality of regions;

an image reader provided in a feed path of said printed sheet for capturing an image on said printed sheet to obtain captured image data;

an computation device for processing said captured image data to compute a measured printed density for each of said regions;

a controller for computing a first amount of ink supply for said regions, respectively, so that said measured printed density is approximately equal to said target printed density, and for controlling said ink supply mechanism in accordance with said first amount of ink supply; and a changing element for changing the first amount of ink supply of said region selected by an operator to a second amount of ink supply adjusted to increase or decrease from said first amount of ink supply in response to an instruction from the operator; and a storage element for storing said second amount of ink supply adjusted by said instruction from the operator which corresponds to said region selected by the operator;

whereby said controller supplies ink to said selected one of said regions in accordance with said second amount of ink supply adjusted by said instruction from the operator, and supplies ink to the remainder of said regions in accordance with said first amount of ink supply computed by said controller.

8. The printing apparatus according to claim 7, wherein said storage element stores a target printed density for said second amount of ink supply as said second amount of ink supply.

* * * * *